United States Patent [19]

Satchell, Jr.

[11] 4,021,330

[45] May 3, 1977

[54] HYDROTREATING A HIGH SULFUR, AROMATIC LIQUID HYDROCARBON

[75] Inventor: Donald P. Satchell, Jr., Morenci, Ariz.

[73] Assignee: Continental Oil Company, Ponca City, Okla.

[22] Filed: Sept. 8, 1975

[21] Appl. No.: 611,275

[52] U.S. Cl. ..... 208/89; 208/144

[51] Int. Cl.[2] ..... C10G 23/02

[58] Field of Search ..... 208/210, 216, 89, 143, 208/144; 260/683.9

[56] References Cited

UNITED STATES PATENTS

| | | | |
|---|---|---|---|
| 3,268,438 | 8/1966 | Scott, Jr. et al. | 208/89 |
| 3,425,810 | 2/1969 | Scott, Jr. | 208/210 |
| 3,505,209 | 4/1970 | Brewer et al. | 208/216 |
| 3,563,886 | 2/1971 | Carlson et al. | 208/210 |
| 3,730,879 | 5/1973 | Christman et al. | 208/210 |
| 3,894,937 | 7/1975 | Bonacci et al. | 208/89 |

*Primary Examiner*—George Crasanakis
*Attorney, Agent, or Firm*—Richard W. Collins

[57] ABSTRACT

Liquid hydrocarbon feedstocks are hydrotreated in a reactor containing a first catalyst bed and a second catalyst bed by passing the hydrocarbon liquid down through both catalyst beds serially and introducing hydrogen between the two catalyst beds, the hydrogen flowing upwardly through the first catalyst bed and downwardly through the second catalyst bed. The process is useful for desulfurization and aromatic saturation of petroleum and coal-derived liquids.

9 Claims, 1 Drawing Figure

HYDROTREATING A HIGH SULFUR, AROMATIC LIQUID HYDROCARBON

BACKGROUND OF THE INVENTION

1. Field of the Invention

This invention relates to hydrotreating of liquid hydrocarbons. More particularly, this invention relates to a method of reducing the sulfur content of high sulfur feedstocks and to saturating the aromatic content of the feedstock. Hydrodesulfurization of hydrocarbon feedstocks is a well-known process in the petroleum refining art, as is hydrogenation of aromatic hydrocarbons. Hydrocarbon feedstocks such as those commonly referred to as distillates, as well as certain kerosenes and jet fuels, frequently are subjected to hydrotreating to meet specifications as to sulfur content and aromaticity. Both hydrodesulfurization and aromatic saturaton have been carried out extensively in the past. Both processes are part of the broader technology involving hydrotreating of hydrocarbon feedstocks, and generally involve passing the feedstock over a fixed catalyst bed at elevated temperature and pressure.

2. Description of the Prior Art

As mentioned above, both hydrodesulfurization and aromatic saturation have been carried out in the past by passing hydrocarbon feedstocks over fixed catalyst beds at elevated temperature and pressure. In cases where the feedstock has a high sulfur content and a high aromatic content, it is often desirable to both hydrodesulfurize and saturate the feedstock. However, the art has been faced with a catalyst selection dilemma when saturating high sulfur aromatic feedstocks. Catalysts having the best aromatic saturation activity are also the most sensitive to the feedstock sulfur content. That is, the catalyst having high aromatic saturation activity is quickly poisoned by the sulfur in a high sulfur feedstock, such that it is desirable to reduce the sulfur content prior to saturating the aromatic components in the feedstock. This has required, in some cases, separate operations for sulfur reduction and saturation.

It might be possible to develop a catalyst having high aromatic saturation activity which is not poisoned by sulfur, but the art has developed standard catalysts for both sulfur reduction and aromatic saturation which are reliable, economical and long-lived. Accordingly, there is no particular incentive for the art to develop a new catalyst.

The term "hydrotreating" as used herein is intended to include both hydrodesulfurization and aromatic saturation, but is not intended to include the process generally referred to in the art as hydrocracking, which involves more severe conditions than are required for hydrodesulfurization and aromatic saturation.

Several processes have been utilized in the past in an effort to desulfurize and saturate high sulfur aromatic hydrocarbon feedstocks. One such process is described in U.S. Pat. No. 3,592,758 which utilizes a dual catalyst hydrogenation system. The process described therein includes subjecting the feedstock plus hydrogen to catalytic hydrofining followed by subjecting the effluent to catalytic hydrogenation using a second sulfur-sensitive catalyst. The process is described as a single stage process, and includes flowing feedstock and hydrogen serially over both catalyst beds using a cocurrent flow of hydrogen and feedstock over both beds.

A process of desulfurizing and saturating a high sulfur aromatic feedstock using a first stage to desulfurize and a second stage to hydrogenate the feedstock is described in U.S. Pat. No. 3,654,139. Still another related process is described in U.S. Pat. No. 3,673,078 which describes a hydrogenation process using a sulfur-resistant catalyst for the desulfurizing stage and a more active catalyst for the aromatic saturation stage. The process described therein involves passing hydrogen counter-currently to the hydrocarbon feedstock through a single reactor containing the two catalyst beds in series. Each of the above-described prior art processes has its relative advantages and disadvantages, and there has been a continuing need for an improved process of desulfurizing and saturating high sulfur aromatic feedstocks.

SUMMARY OF THE INVENTION

According to the present invention, a high sulfur aromatic feedstock is introduced to the top of a reactor containing a first catalyst bed in the upper portion thereof and a second catalyst bed in the lower portion thereof. The first catalyst bed is a sulfur-resistant catalyst which is active for desulfurizing the feedstock. The second catalyst bed is a sulfur-sensitive catalyst which is active for aromatic saturation of the feedstock. Hydrogen is intoduced to the reactor at a point between the two catalyst beds, and flows upwardly through the first catalyst bed and downwardly through the second catalyst bed. The hydrogen flowing upwardly through the first catalyst bed sweeps out hydrogen sulfide which is produced as the feedstock is desulfurized therein, and the hydrogen plus hydrogen sulfide is passed to an amine scrubber or the equivalent for removal of the hydrogen sulfide, followed by recycling of the hydrogen to the reactor. The hydrogen flowing through the second catalyst bed is also recovered and recycled to the reactor. By the process of this invention, a high sulfur aromatic feedstock can be processed for both hydrodesulfurization and aromatic saturation in a single reactor utilizing a sulfur-resistant catalyst for the desulfurizing step and a sulfur-sensitive catalyst for the aromatic saturation step. By introducing hydrogen intermediate the two catalyst beds, the hydrogen sulfide produced in the upper catalyst bed is removed from the reactor before it can contact the sulfur-sensitive catalyst in the bottom of the reactor, enabling a sulfur-sensitive catalyst to be used in the reactor, and enabling both desulfurization and aromatic saturation to be carried out in a single reactor.

BRIEF DESCRIPTION OF THE DRAWINGS

The drawing is a schematic illustration of the process of the invention.

DESCRIPTION OF THE PREFERRED EMBODIMENT

Figure 1:
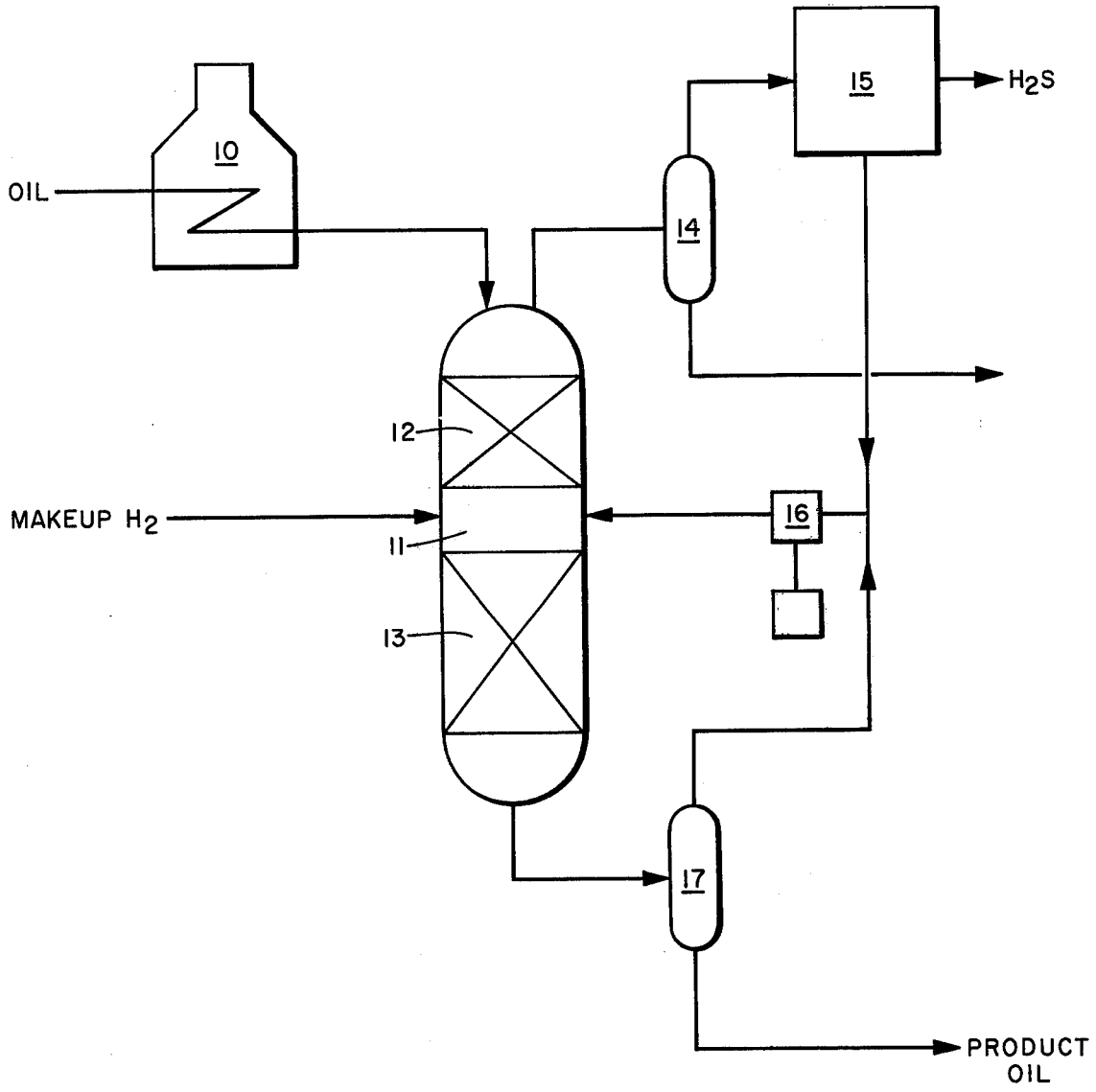

The preferred embodiment of the invention is best described by reference to the drawing. High sulfur aromatic feedstock is intoduced to a furnace 10 where it is heated and then introduced to the top of reactor 11. Reactor 11 contains a first catalyst bed 12 and a second catalyst bed 13. First catalyst bed 12 is a sulfur-resistant catalyst, and may be one of several commercially available catalysts. Typically, the sulfur-resistant catalyst is a cobalt-molybdenum catalyst supported on an alumina carrier. The lower catalyst bed 13 is a sulfur-sensitive catalyst, high in activity for aromatic saturation. This catalyst may also be one of several commercially-available catalysts such as a nickel-molybdenum catalyst supported on an alumina carrier, or a nickel-tungsten catalyst supported on an alumina carrier. As previously noted, the catalysts themselves do not constitute a part of the invention, as they are well known and readily available. Hydrogen is introduced to reactor 11 at a point between the two catalyst beds, and the total hydrogen introduced to the reactor comprises feed hydrogen and recycle hydrogen. The hydrogen passes upwardly through upper catalyst 12, countercurrent to the oil flowing downwardly therethrough, and sulfur compounds contained in the oil feed are converted primarily to hydrogen sulfide in catalyst bed 12. The hydrogen sulfide thus formed is swept out of the reactor 11 into flash drum 14 wherein entrained oil and heavier hydrocarbon components are removed, with the hydrogen and hydrogen sulfide being taken off overhead to a scrubber 15 where the hydrogen sulfide is removed by amine absorption or other suitable processing. Hydrogen sulfide-free hydrogen is then passed to compressor 16 for repressurization and recycle into reactor 11. A portion of the hydrogen passes downwardly through lower catalyst bed 13, cocurrently with oil which has been reduced in sulfur content, and then out of reactor 11 into a separator 17 where hydrogen is separated from product oil and returned to compressor 16 for recycle into reactor 11. Product oil having a low sulfur content and a high degree of aromatic saturation is recovered from the bottom of separator 17. The above description generally describes the preferred embodiment of the invention. As mentioned previously, the invention is primarily directed at solving the catalyst selection dilemma faced when a high sulfur aromatic feedstock is to be hydrogenated. The process of this invention is particularly suitable for aromatic saturation of certain kerosenes and jet fuels which have a high sulfur content.

The reaction conditions for the process of this invention include a temperature range of from 600° to 800° F, with a preferred range of 650° to 700° F, and reactor pressures of from 100 to 1000 psig, with pressures of from 500 to 1000 psig preferred. The liquid hourly space velocity (LHSV) may be from 1 to 4, and preferably is near 2. The total hydrogen to the reactor (fresh hydrogen feed plus recycle hydrogen) is in the range of 500 to 2,000 standard cubic feet per barrel of feedstock, with a preferred range of from 1,000 to 2,000 standard cubic feet per barrel. The hydrogen and hydrogen sulfide passing from the top of reactor 11 to flash drum or separator 14 is treated for removal of hydrogen sulfide in scrubber 15, and in some cases removal of ammonia, formed from nitrogen compounds in the feedstock, may be necessary. The ammonia is easily removed by conventional processing. When operating at the conditions described above, the amount of hydrocracking which takes place in the reactor is essentially negligible, and the hydrogen consumption is predominantly attributable to aromatic saturation. The essential feature of this invention which distinguishes it from prior art hydrotreating processes involves introduction of hydrogen to a reactor at a point between an upper sulfur-resistant catalyst bed and a lower sulfur-sensitive catalyst bed having high activity for aromatic saturation. Prior to this invention, it has either been necessary to carry out a multi-stage reaction with a plurality of reactors, or else a compromise has been necessary in the selection of the catalyst. As noted previously, the more active catalysts for aromatic saturation are generally more sulfur-sensitive, such that in treating a high sulfur aromatic feedstock, it has not previously been practical to use a high activity catalyst because of the catalyst poisoning problem. A specific example of the use of the process of this invention in preparing a low sulfur jet fuel is described below.

EXAMPLE 1

A liquid hydrocarbon feedstock containing 0.5 weight percent sulfur and having a boiling range of from 340° F to 540° F is introduced to a furnace and heated to 675° F. The heated hydrocarbon is then introduced into the top of a reactor maintained at a pressure of 700 psig. The feedstock passes downwardly over an upper catalyst bed comprised of CoO (3 percent by weight) and $MoO_3$ (12 percent by weight) supported on an aluminum oxide carrier. The liquid effluent from the upper catalyst bed then passes downwardly through a lower catalyst bed comprised of NiO (2 weight percent) and $MoO_3$ (6 weight percent) supported on an aluminum oxide carrier. Hydrogen is introduced to the reactor at a point between the upper and lower catalyst beds in a total amount (fresh feed plus recycle) of 2,000 standard cubic feet per barrel of hydrocarbon feedstock. A portion of the hydrogen passes through the upper catalyst bed countercurrent to the liquid flow, and strips out hydrogen sulfide formed therein. The hydrogen stream containing stripped hydrogen sulfide is treated in an amine scrubber to remove hydrogen sulfide and is then recycled to the reactor through a compressor. The hydrocarbon feedstock which had an initial sulfur content of 0.5 weight percent and an aromatic content of 12 percent is converted in the reactor to a jet fuel having a sulfur content of 0.06 percent by weight and an aromatic content of less than 1 percent by weight. The product easily meets specification as to sulfur content for most jet fuels, as the specification generally is about 0.3 percent by weight.

While the invention has been described by reference to processing a particular high sulfur aromatic hydrocarbon, it will be appreciated that the process is applicable to hydrocarbon feedstocks without regard to their origin, so long as it is desired that the sulfur content of the feedstock be reduced and that the aromatic components of the feedstock be saturated. Feedstocks derived from sources other than petroleum, such as shale oils and coal-derived liquids, are also suitable as feedstocks for the invention. In the case of a coal-derived feedstock, the nitrogen content might be sufficiently high that provision must be made for removal of ammonia formed in the reactor. Other modifications and variations will be apparent to those skilled in the art, and the invention is not to be considered limited by the specific illustration above, but it is to be defined by the appended claims.

I claim:

1. A method of hydrotreating a high sulfur, aromatic liquid hydrocarbon feedstock comprising:

a. introducing said feedstock into the upper portion of a reactor for downward flow therethrough, said reactor having a first sulfur-resistant catalyst bed in the upper portion thereof and a second sulfur-sensitive catalyst bed in the lower portion thereof;

b. introducing hydrogen to the reactor at a point between the two catalyst beds, the hydrogen flowing countercurrent to the feedstock through the first catalyst bed and cocurrent with the feedstock through the second catalyst bed;

c. recovering said hydrogen that passes overhead through said first catalyst bed and said hydrogen that passes downwardly through said second catalyst bed and recycling at least a portion of the hydrogen to step (b); and d. recovering hydrotreated product from the bottom of said reactor.

2. The method of claim 1 wherein the liquid feedstock is an aromatic petroleum distillate high in sulfur content.

3. The method of claim 2 wherein the first catalyst bed comprises oxides of cobalt and molybdenum on an alumina carrier and the second catalyst bed is comprised of oxides of nickel and molybdenum on an alumina carrier.

4. The method of claim 2 wherein the hydrogen passing through the first catalyst bed is treated for removal of hydrogen sulfide and the treated hydrogen is recycled to step (b).

5. The method of claim 2 wherein the first catalyst bed comprises a cobalt-molybdenum-alumina catalyst and the second catalyst bed comprises a catalyst selected from the group consisting of nickel-molybdenum-alumina catalyst and nickel-tungsten-alumina catalyst.

6. The method of claim 5 wherein:

a. the feedstock is a petroleum distillate containing more than 0.5 percent by weight sulfur;

b. the first catalyst bed comprises about 3 percent by weight cobalt oxide and about 15 percent by weight molybdenum oxide;

c. the second catalyst bed comprises about 3 percent by weight nickel oxide and about 15 percent by weight molybdenum oxide;

d. the reactor is maintained at a temperature of from 650° to 700° F and a pressure of from 500 to 1000 psig, the feedstock is introduced at a liquid hourly space velocity of about 2, and the total hydrogen introduced to the reactor is about 2,000 SCF/bbl of feedstock.

7. The method of claim 6 wherein the hydrotreated product has a sulfur content of less than 0.3 percent by weight.

8. The method of claim 1 wherein the feedstock is a coal-derived liquid.

9. The method of claim 6 wherein the hydrogen passing through the first catalyst bed is treated for removal of hydrogen sulfide and the treated hydrogen is recycled to step (b).

* * * * *